US006414665B2

(12) United States Patent
Libsch et al.

(10) Patent No.: US 6,414,665 B2
(45) **Date of Patent: *Jul. 2, 2002**

(54) MULTIPLEXING PIXEL CIRCUITS

(75) Inventors: Frank R. Libsch, White Plains; Shui-Chih A. Lien, Briarcliff Manor; Kai R. Schleupen, Yorktown Heights, all of NY (US); Robert L. Wisnieff, Ridgefield, CT (US)

(73) Assignee: International Business Machines Corporation, Armonk, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/186,018

(22) Filed: Nov. 4, 1998

(51) Int. Cl.[7] ..... G09G 3/36
(52) U.S. Cl. ..... 345/92; 345/93; 349/42
(58) Field of Search ..... 345/90, 93, 98, 345/95, 100, 87, 103, 208, 94, 96, 205, 206, 92; 349/42, 48, 151

(56) References Cited

U.S. PATENT DOCUMENTS 5,120,964 A 6/1992 Wieczorek
5,122,792 A * 6/1992 Stewart ..... 340/793
5,175,446 A 12/1992 Stewart
5,581,273 A * 12/1996 Yoneda et al. ..... 345/90
5,641,974 A 6/1997 den Boer et al.
5,691,783 A * 11/1997 Numao et al. ..... 349/48
5,844,538 A * 12/1998 Shiraki et al. ..... 345/98
5,903,249 A * 5/1999 Koyama et al. ..... 345/92
5,926,158 A * 7/1999 Yoneda et al. ..... 345/90
6,023,308 A * 2/2000 Takemura ..... 349/42
6,104,067 A * 8/2000 Zhang et al. ..... 257/365

* cited by examiner

*Primary Examiner*—Bipin Shalwala
*Assistant Examiner*—Mansour M. Said
(74) *Attorney, Agent, or Firm*—F.Chau&Associates,LLP

(57) ABSTRACT

An active matrix display in accordance with the present invention includes a plurality of pixels arranged in an array. At least two transistors associated with each pixel are included. The transistors are serially connected to each other and disposed within the array for switching the pixels on and off according to data and gate signals. A data line is coupled to a first end of the serially connected transistors for each pixel. A second end of the serially connected transistors is coupled to a storage device. The serially connected transistors provide multiplexing capability for at least one of data signal multiplexing and gate signal multiplexing.

34 Claims, 11 Drawing Sheets

| FIG. 9A |
|---|
| FIG. 9B |

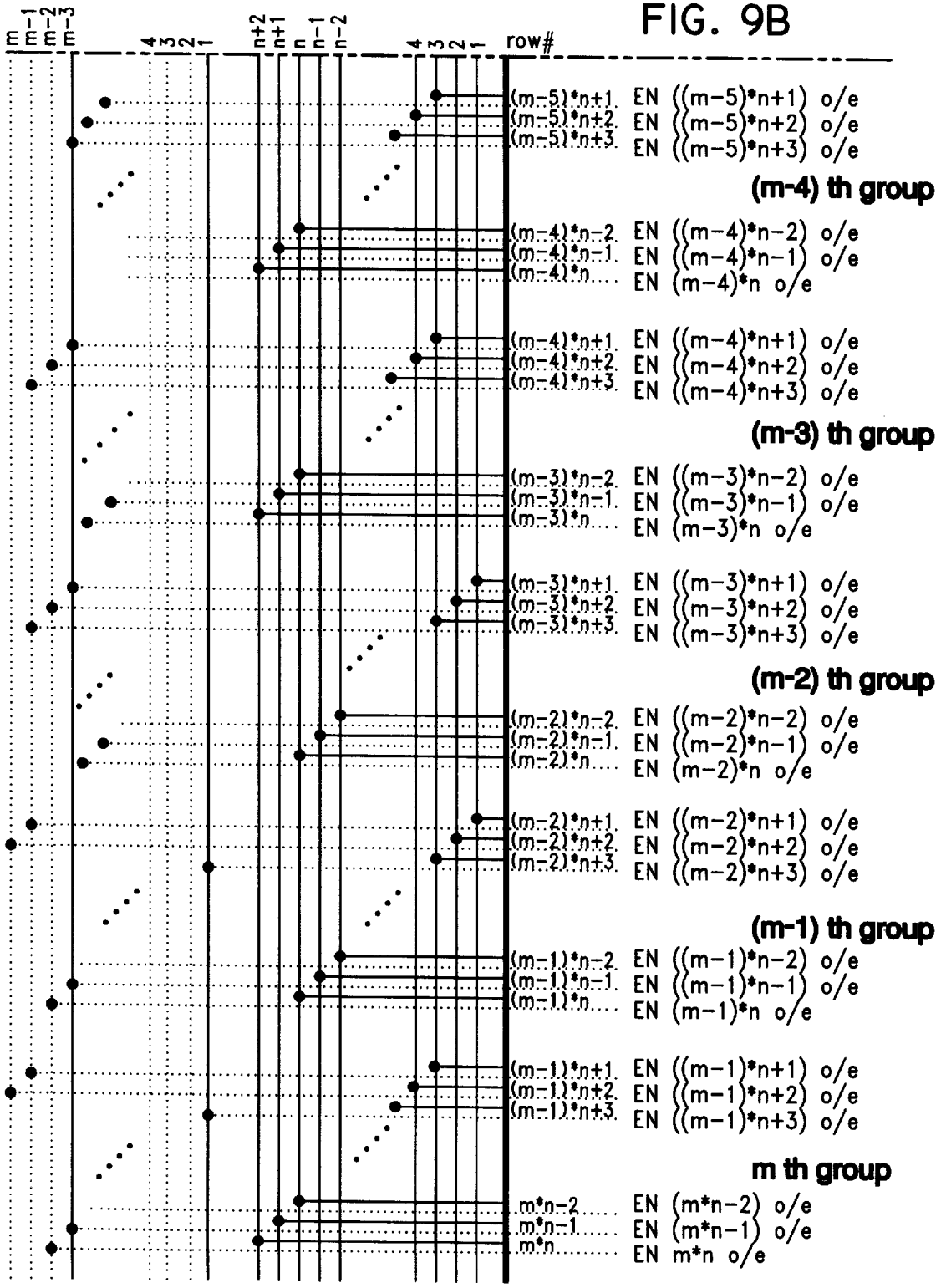
FIG. 9B
m m-1 m-2 m-3
4 3 2 1
n+2 n+1 n n-1 n-2
4 3 2 1
row#
(m-5)*n+1 EN ((m-5)*n+1) o/e
(m-5)*n+2 EN ((m-5)*n+2) o/e
(m-5)*n+3 EN ((m-5)*n+3) o/e
(m-4) th group
(m-4)*n-2 EN ((m-4)*n-2) o/e
(m-4)*n-1 EN ((m-4)*n-1) o/e
(m-4)*n EN (m-4)*n o/e
(m-4)*n+1 EN ((m-4)*n+1) o/e
(m-4)*n+2 EN ((m-4)*n+2) o/e
(m-4)*n+3 EN ((m-4)*n+3) o/e
(m-3) th group
(m-3)*n-2 EN ((m-3)*n-2) o/e
(m-3)*n-1 EN ((m-3)*n-1) o/e
(m-3)*n EN (m-3)*n o/e
(m-3)*n+1 EN ((m-3)*n+1) o/e
(m-3)*n+2 EN ((m-3)*n+2) o/e
(m-3)*n+3 EN ((m-3)*n+3) o/e
(m-2) th group
(m-2)*n-2 EN ((m-2)*n-2) o/e
(m-2)*n-1 EN ((m-2)*n-1) o/e
(m-2)*n EN (m-2)*n o/e
(m-2)*n+1 EN ((m-2)*n+1) o/e
(m-2)*n+2 EN ((m-2)*n+2) o/e
(m-2)*n+3 EN ((m-2)*n+3) o/e
(m-1) th group
(m-1)*n-2 EN ((m-1)*n-2) o/e
(m-1)*n-1 EN ((m-1)*n-1) o/e
(m-1)*n EN (m-1)*n o/e
(m-1)*n+1 EN ((m-1)*n+1) o/e
(m-1)*n+2 EN ((m-1)*n+2) o/e
(m-1)*n+3 EN ((m-1)*n+3) o/e
m th group
m*n-2 EN (m*n-2) o/e
m*n-1 EN (m*n-1) o/e
m*n EN m*n o/e

MULTIPLEXING PIXEL CIRCUITS

BACKGROUND OF THE INVENTION

1. Field of the Invention

The present invention relates to pixel display circuits and, more particularly, to a circuit for providing integrated data and gate multiplexing without impact to acceptable standards for displays.

2. Description of the Related Art

Due to poor charging ability in amorphous silicon thin film transistors (a-Si TFTs) resulting from inherently low TFT transconductance, all commercially available a-Si TFT liquid crystal displays (LCD) include an array of pixel elements connected with row and column metal lines. The row and column drivers require higher transconductance devices. The row and column drivers typically include crystalline silicon technology and are separately fabricated and attached to the a-Si TFT LCDs. Over the years, there have been attempts at integrating some level of multiplexing between the attached crystalline silicon drivers and the pixel array. See for example, U.S. Pat. No. 5,175,446 to R. Stewart. In this way, the number of crystalline drivers needed could be reduced. These prior art designs follow a circuit approach that is commonly used in crystalline silicon circuit designs. Even simple 2:1 level multiplexing schemes at the edge of a pixel array have not been implemented for a-Si TFT LCD circuits. Although not realized for direct view a-Si TFT LCDs, multiplexer circuits have been implemented with some success in smaller displays for example, in light valves and in poly-silicon technology. Poly-silicon TFTs make it possible to realize a higher transconductance TFT. However, implementing poly-silicon technology on larger and/or high resolution TFT LCDs leads to an unacceptably higher RC load and/or higher bandwidth rates of the rows and columns.

Therefore, a need exists for a circuit for providing integrated data and gate multiplexing for active matrix LCDs without impacting acceptable display limits. A further need exists for a reduction in data drivers and gate drivers to reduce costs of these displays.

SUMMARY OF THE INVENTION

An active matrix display in accordance with the present invention includes a plurality of pixels arranged in an array. At least two transistors associated with each pixel are included. The transistors are serially connected to each other and disposed within the array for switching the pixels on and off according to data and gate signals. A data line is coupled to a first end of the serially connected transistors for each pixel. A second end of the serially connected transistors is coupled to a storage device. The serially connected transistors provide multiplexing capability for at least one of data signal multiplexing and gate signal multiplexing.

Another active matrix display in accordance with the present invention includes a plurality of pixels arranged in an array including rows and columns. At least two transistors associated with each pixel, the transistors being serially connected and positioned within the array for switching the pixels on and off. A plurality of data lines run substantially parallel to the columns. A plurality of scan lines run substantially parallel to the rows. The data lines and scan lines being coupled to the transistors of the pixels such that the data lines provide data multiplexing for each pixel and the scan lines provide gate multiplexing for each pixel.

In alternate embodiments of the displays in accordance with the invention, one of the at least two transistors may be shared between adjacent pixels to further reduce gate or data drivers. The pixels may modulate light in a transmissive mode and/or a reflective mode. The array preferably includes rows and columns and the control lines may select the pixels in different rows simultaneously. The simultaneously selected pixels may share a data line. Control lines may include data lines and the simultaneously selected pixels may each use a different data line. The control lines may includes scan lines and/or capacitance storage lines. The control lines may be coupled to the transistors by a low impedance contact path which may include a metal, polycrystalline silicon, a capacitor or a combination thereof. The display may include a liquid crystal display, and the transistors preferably include thin film transistors.

The data multiplexing may include L:1 multiplexing where L is an integer greater than one. The gate multiplexing may include m:1 multiplexing where m is an integer greater than one. The data lines may select pixels in different rows simultaneously, or the pixels may share a data line. The display may further include logic circuitry for controlling the multiplexing in accordance with control signals. The transistors are preferably disposed on a substrate and the pixels are formed over the transistors These and other objects, features and advantages of the present invention will become apparent from the following detailed description of illustrative embodiments thereof, which is to be read in connection with the accompanying drawings.

BRIEF DESCRIPTION OF DRAWINGS

The invention will be described in detail in the following description of preferred embodiments with reference to the following figures wherein.

DETAILED DESCRIPTION OF PREFERRED EMBODIMENTS

The present invention relates to liquid crystal display circuits and, more particularly, to a circuit for providing integrated data and gate multiplexing without impact to acceptable standards of the displays. The present invention provides a novel design for introducing gate and data line multiplexing functions from circuitry implemented within the pixel rather than from circuitry at the data or gate line ends. The present invention does not follow the prior art schemes of implementing crystalline silicon multiplexer designs with amorphous silicon thin film transistors (TFTs), nor does the present invention follow the prior art scheme of placing the multiplexers between the pixel array and the externally attached crystalline silicon drivers.

The present invention provides an RC load that is reduced to about a load within a pixel. This may be implemented by employing a TFT gate of minimum length and width as described hereinbelow. Whereas the prior art needed to drive a full load of the gate or data line to accomplish gate or data multiplexing.

The present invention employs more than one TFT in a pixel. All TFTs within the pixel are connected in series. This connection includes a first source connected to a data line and a last drain in the series of TFTs connected to a storage capacitor and/or an LC capacitor. Multiplexing as provided by the present invention places the multiplexer circuitry within each pixel and employs several serially connected TFTs to provide the multiplexing function. A data line is connected to the source of one TFT, and the drain of this TFT is connected to the source of another TFT and so on until the last serially connected TFT has its drain connected to one electrode of a storage capacitor and a liquid crystal flag. The liquid crystal flag (not shown) is one of the electrodes forming a liquid crystal capacitor. The liquid crystal flag is preferably formed from indium-tin oxide (ITO).

Figure 2:
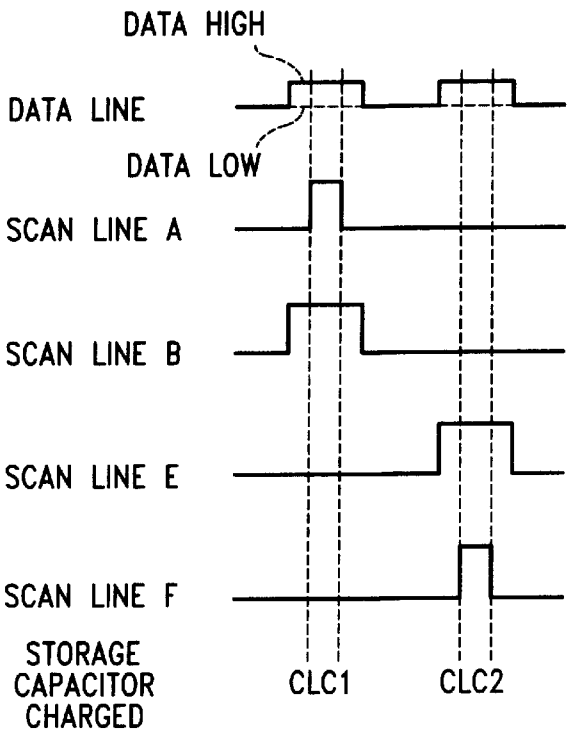
FIG. 2 is a timing diagram for the circuit of FIG. 1 in accordance with the present invention.
Figure 1:
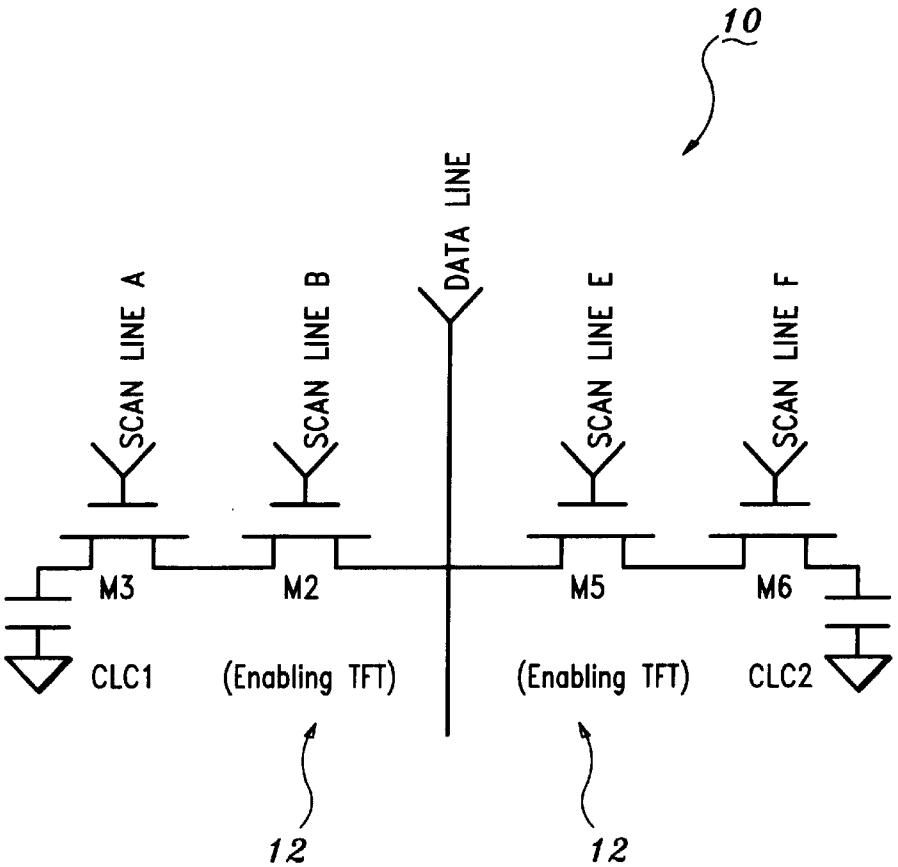
FIG. 1 is a schematic diagram of a pixel circuit showing two TFTs in series per pixel in accordance with the present invention.

The number of serially connected TFTs may be two or more. The more TFTs per pixel, the higher the level of multiplexing that may by implemented. However, the more TFTs per pixel the lower the aperture ratio for that pixel since the amount of available chip area is reduced by the presence of the TFTs and enable lines connected thereto. There is no minimum aperture ratio for reflective displays since the circuitry may be placed below reflector pixels. Referring now in detail to the figures in which like numerals represent the same or similar elements and initially to FIG. 1, a schematic diagram of a two pixel circuit 10 in accordance with the present invention is shown. Pixel circuit 10 includes two pixels 12 with a common data line (DATA LINE) and two thin film transistors (TFTs)per pixel 12, M2 and M3 and M5 and M6, respectively. Enabling TFTs M2 and M5 are activated by scan line B and scan line E, respectively. Data line signal transfer TFTs M3 and M6 provide access from DATA LINE to pixel capacitors CLC1 and CLC2. M3 and M6 are enabled by scan line A and scan line F, respectively. Advantageously, all TFTs shown in FIG. 1 are located at pixels 12. An illustrative timing diagram is shown in FIG. 2 to show the states of pixel circuit 10 of FIG. 1.

Figure 4:
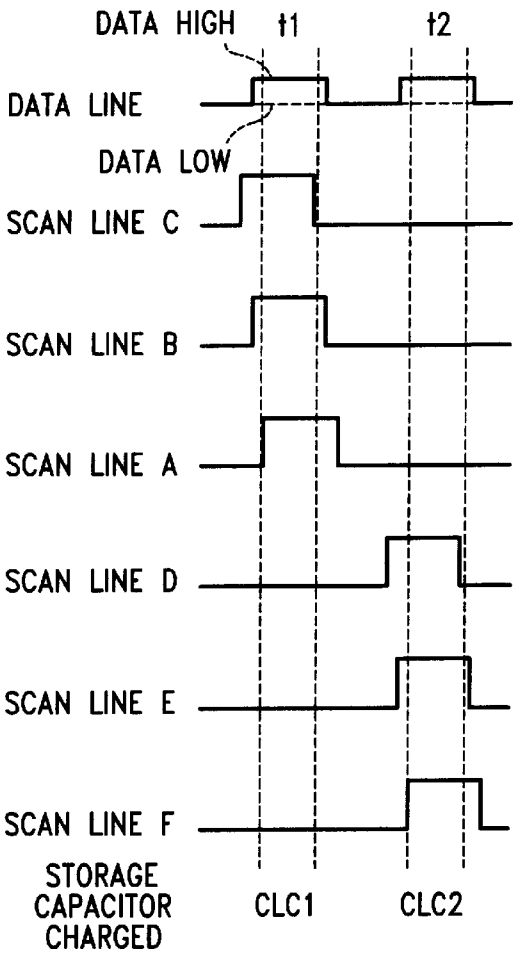
FIG. 4 is a timing diagram for the circuit of FIG. 3 in accordance with the present invention.
Figure 3:
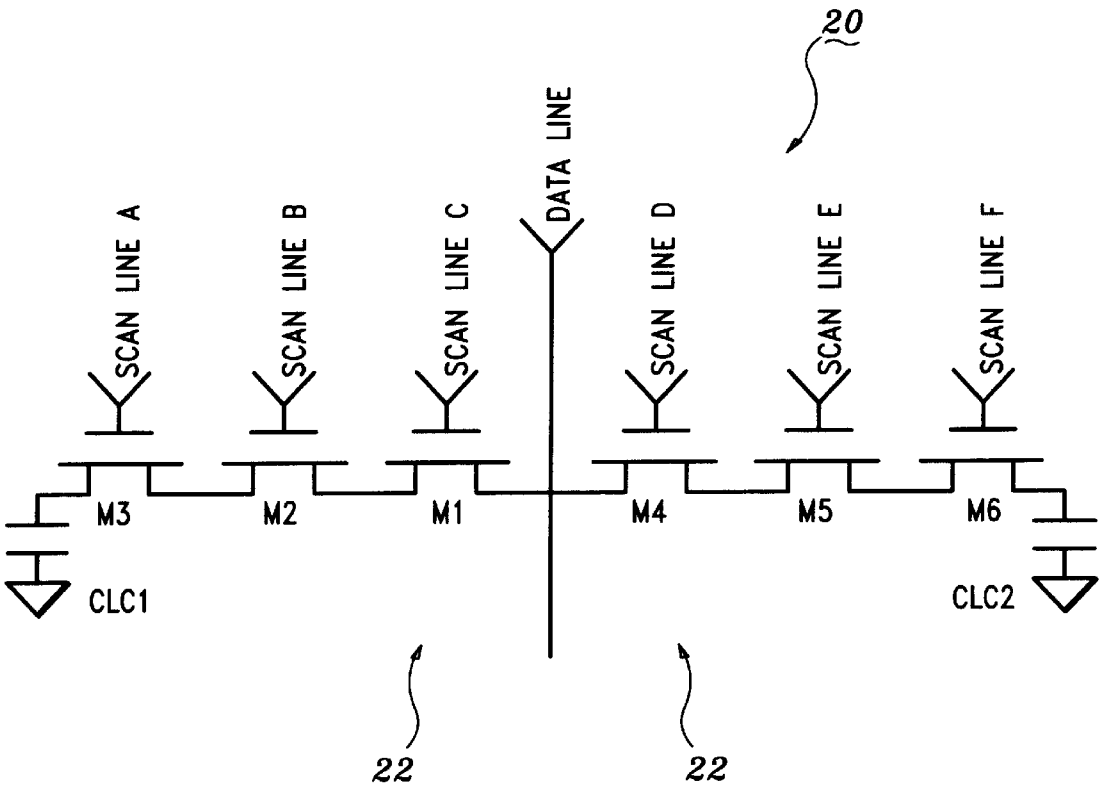
FIG. 3 is a schematic diagram of a pixel circuit showing three TFTs in series per pixel and additional scan lines in accordance with the present invention.

Referring to FIG. 3, a schematic diagram shows an alternate embodiment of a pixel circuit shown as pixel circuit 20. Circuit 20 includes additional enabling TFTs M1 and M4 in series with the other TFTs. TFTs M1 and M4 are enabled by signal line C and signal line D, respectively. In a similar way, additional enabling TFTs may be added in series with the TFTS to provide a similar function. The additional TFTs in series provide, among other things, a higher level of gate line multiplexing, more scan lines through each pixel 22 and an integer number of threshold drops from scan line C (or D) voltage to a gate of TFT M3 (or M6). It is to be understood that if a data voltage at the source of a first TFT (M1 or M4), connected to DATA LINE, is comparable to an ENABLE voltage, a cumulative threshold voltage drop in the data voltage after each TFT will result. This TFT threshold voltage alteration on the data voltage may be rendered nonexistent if the pixel TFTs are overdriven such that the ENABLE voltage is at least one threshold voltage larger than the maximum data line voltage. In one example for amorphous silicon TFT LCDs, this condition is easily satisfied since the data voltage is typically in the range of 10 V or less (i.e., ±5 V centered around a top plate common voltage of about 7 V), and the "on" gate voltage (that would be comparable to the ENABLE voltage) is approximately 13 V or greater than the maximum data voltage, or approximately 25 V. FIG. 4 illustratively presents a timing diagram for circuit 20 of FIG. 3.

Figure 5:
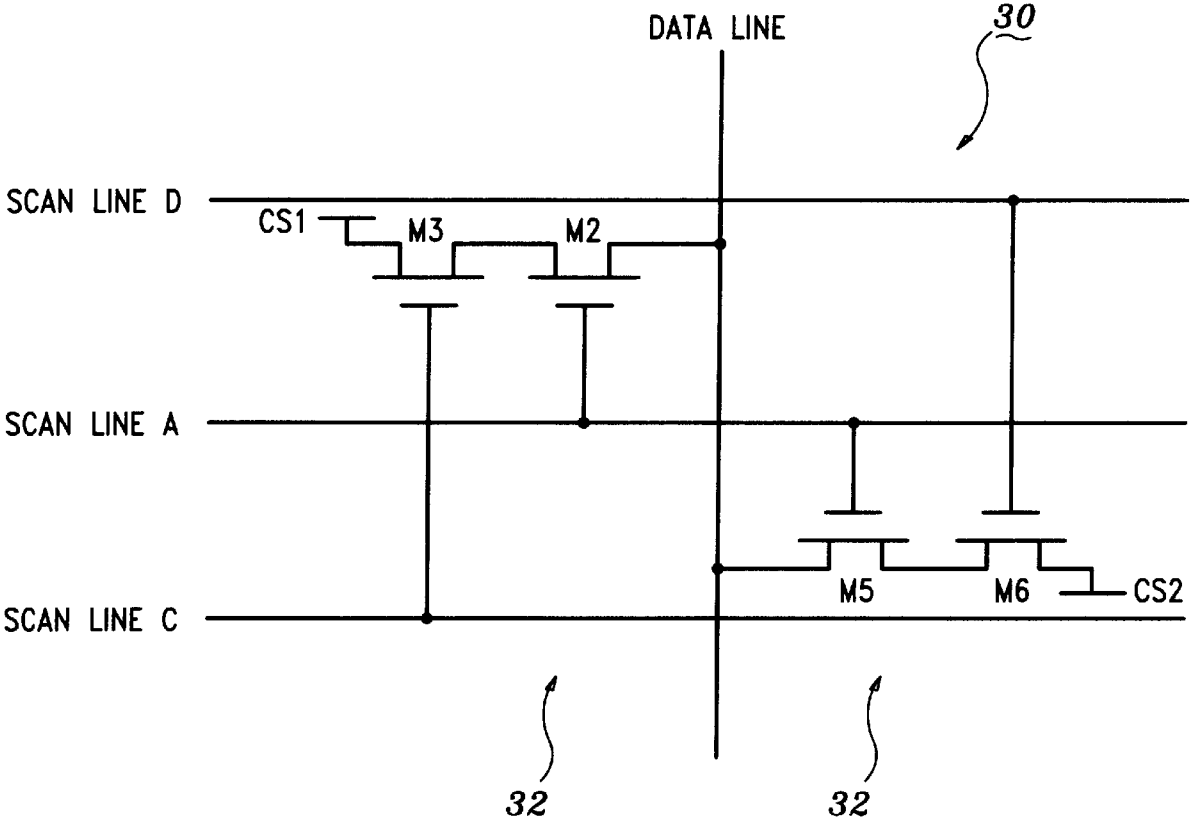
FIG. 5 is a schematic diagram of another pixel circuit showing two TFTs in series per pixel in accordance with the present invention.

Referring to FIG. 5, another embodiment of the present invention is shown as pixel circuit 30. The number of scan lines are reduced to effectively two per pixel. Scan lines between pixels are shared to reduce their number. As shown in circuit 30, scan line D is shared with a previous row of pixels where scan line C is shared with a next row of pixels. Circuit 30 provides a more efficient layout of pixels and thus maximizes aperture area.

Figure 6:
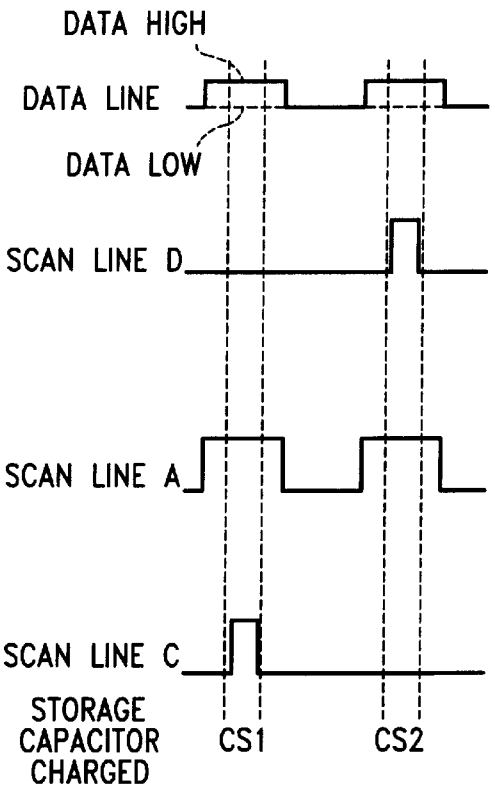
FIG. 6 is a timing diagram for the circuit of FIG. 5 in accordance with the present invention.

An illustrative timing diagram is shown for circuit 30 in FIG. 6. Referring now to FIGS. 5 and 6, a mode of operation is provided where scan line A pulse high width overlaps scan line C and scan line D pulses. The significance of this is that the falling edge of scan line A pulses are completed after that of scan line C of scan line D falling edges so as to ensure that a gate node of M3 or M6 is discharged and will not act as a charge storage node which would prevent M3 and/or M6 from turning off. Further, only two scan lines are needed to turn a pixel on, for example, scan line A and D or scan line A and C. The third scan line provides a multiplexing capability in accordance with the present invention. In this example, a shared common DATA LINE between pixels 32 provides a 2:1 data multiplexing function, and the three scan lines A, C and D provide an m:1 gate demultiplexing function, where m is an integer greater than 1.

The pulse width on scan line A is larger than that on scan line C or D. This implementation provides scan line pulse flexibility and in general, scan line pulse widths and relative positions may be different between scan line A and scan line D and scan line C. For example, when scan line A is high, enable TFTs M2 and MS are turned on. Scan line C and D voltages are placed on gates of TFTs M3 and M6, respectively. If scan line C (or D) is high, TFT M3 (or M6) conducts and transfers a data voltage to storage capacitors CS1 (or CS2). If scan line C (or D) is low, TFT M3 (or M6)

does not conduct, and the data line voltage is not transferred to CS1 (or CS2). The timing diagram of FIG. 6 is for normal scan line multiplexing. For simplicity, a liquid crystal voltage is not shown, however the liquid crystal voltage is connected across a source of TFT M3 (M6) where CS1 (CS2) is connected and the other node is connected to a common plate voltage. The common plate extends over a surface of the device and is preferably formed from ITO.

Figure 8:
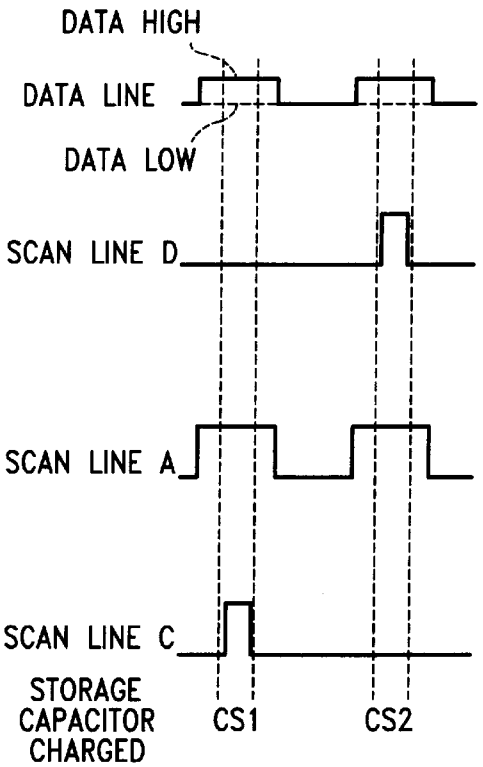
FIG. 8 is a timing diagram for the circuit of FIG. 7 in accordance with the present invention.
Figure 7:
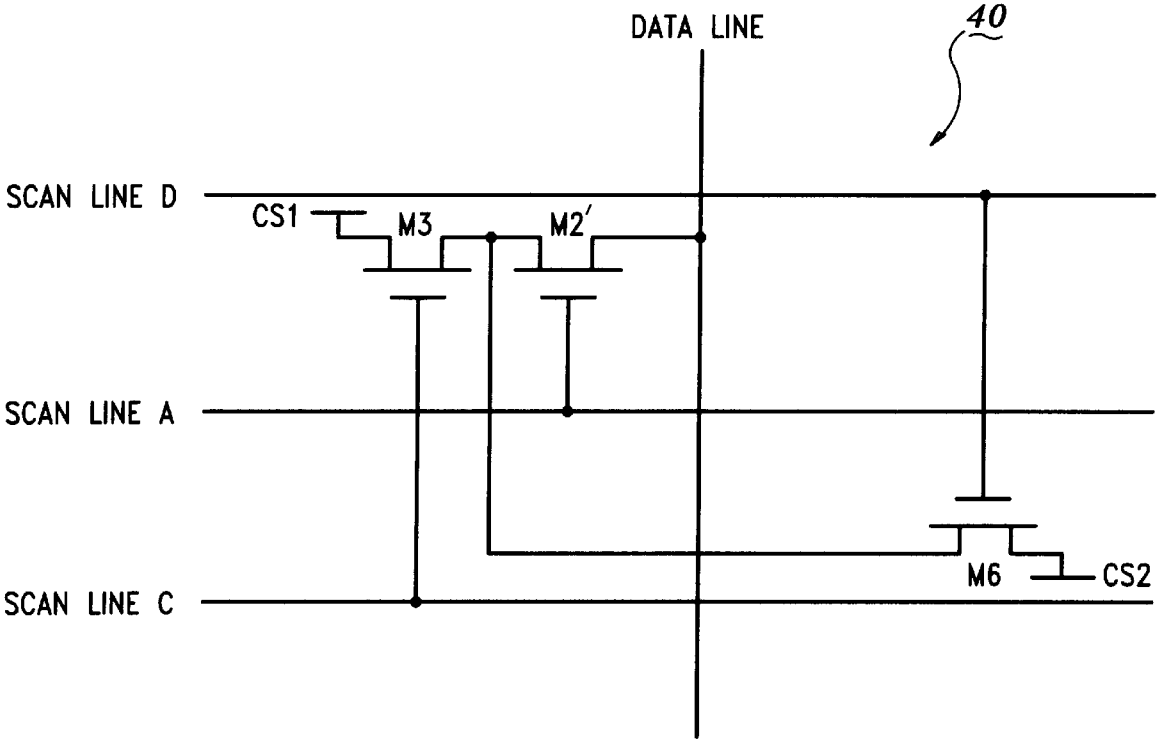
FIG. 7 is a schematic diagram of a pixel circuit effectively having one and one half TFTs per pixel due to a shared TFT between adjacent pixels in accordance with the present invention.

Referring to FIG. 7, a circuit 40 is shown which is another embodiment of circuit 30 of FIG. 5. In circuit 40, the serially accessed and redundant enable TFTs (M5 and M2) of circuit 30 are replaced with a single TFT M2' which is shared between two pixels. FIG. 8 illustratively presents a timing diagram for circuit 40 of FIG. 7.

Figures 9, 9A:
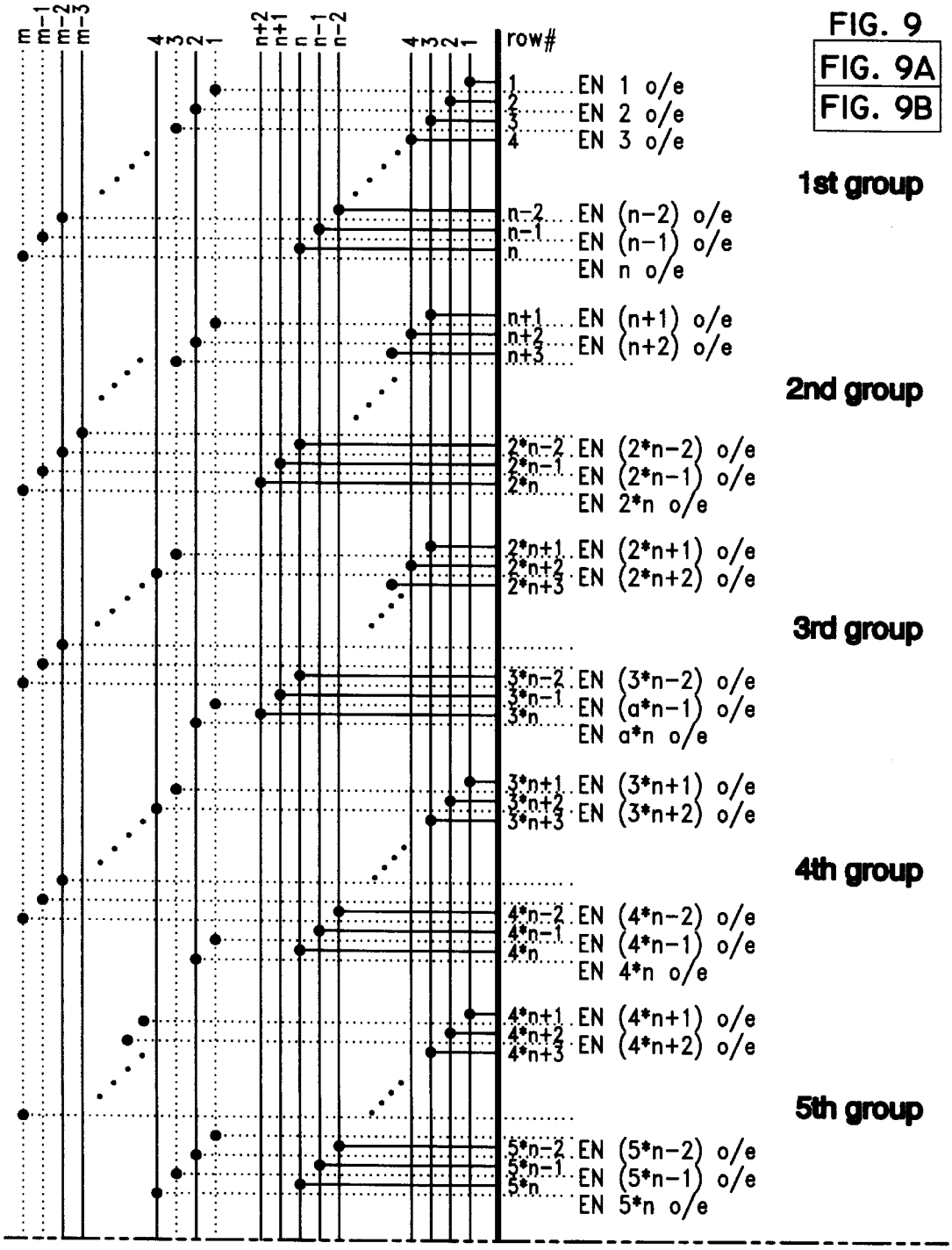
FIG. 9 is a schematic diagram showing a fanout wiring for a demultiplexer in an active matrix array in accordance with the present invention.

Referring to FIG. 9, an illustrative example of row fan-out wiring for gate demultiplexing is shown. An m:1 gate multiplexing function is provided. Signal line labeled "EN1 o/e" through EN m*n o/e" represent pulses to the gates of the enable TFTs M2 and M5. The odd (M2) and even (M5) pixel access TFTs are designated by the nomenclature "o" and "e". Also, "row #"1 through m*n represent scan lines to which the storage capacitors (i.e., CS1 and CS2) overlap onto. In one example, if m=n, and XGA and SXGA color displays are used, gate driver outputs may be multiplexed to approximately 28:1 and 32:1, respectively.

The above figures have shown gate driver outputs being multiplexed 2:1, however, higher data line multiplexing is possible through the introduction of other scan lines.

Figure 10:
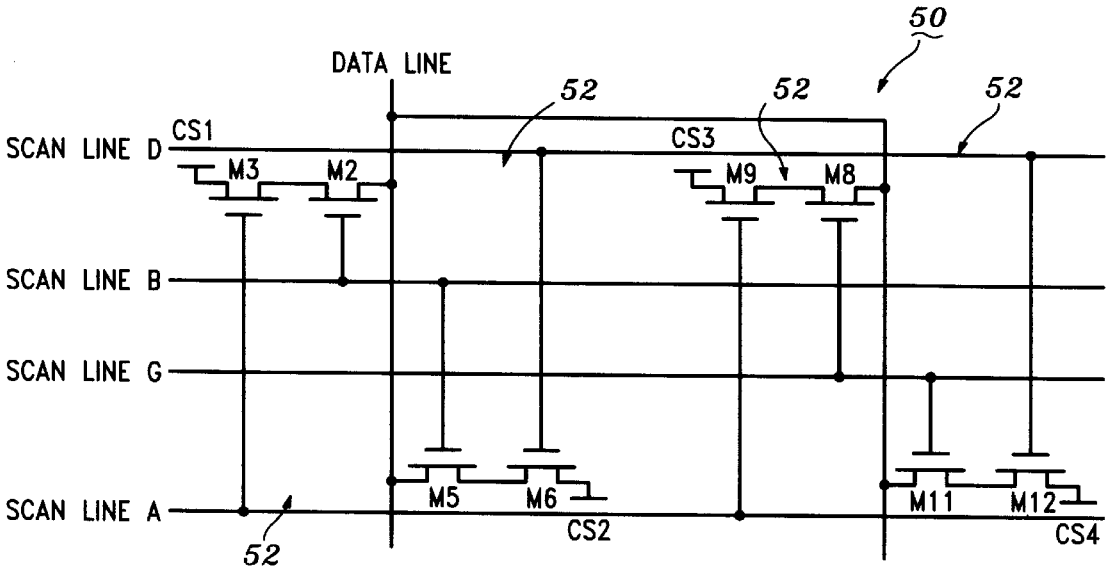
FIG. 10 is a schematic diagram of another embodiment of the pixel circuit of FIG. 5 showing an additional scan line to achieve 4:1 multiplexing in accordance with the present invention.
Figure 11:
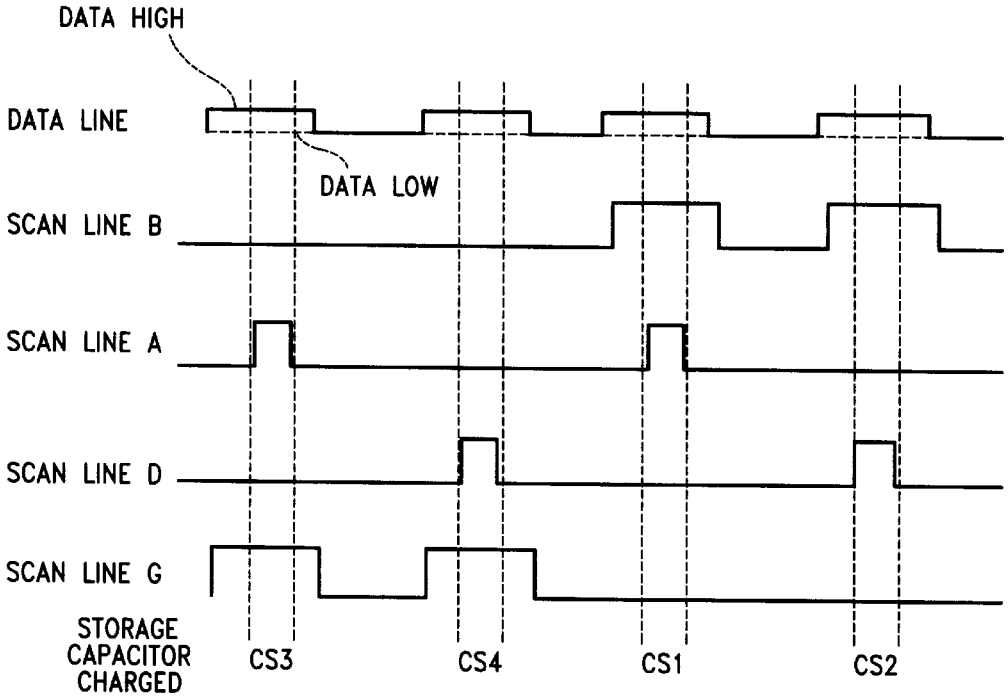
FIG. 11 is a timing diagram for the circuit of FIG. 10 in accordance with the present invention.

Referring to FIG. 10, circuit 30 of FIG. 5 is shown as circuit 50 having an additional scan line G to provide increased data multiplexing from 2:1 to 4:1. Circuit 50 includes four pixels 52. The TFTs M8, M9, M11 and M12 function similarly to TFTs M2, M3, M5 and M6. CS3 and CS4 function similarly to CS1 and CS2. By repeating the circuit pattern of FIG. 10, a circuit is provided in accordance with the present invention which incorporates m:1 gate demultiplexing and L:1 data demultiplexing, where m and L are integers greater than 1. FIG. 11 illustratively shows a timing diagram for circuit 50.

Figure 12:
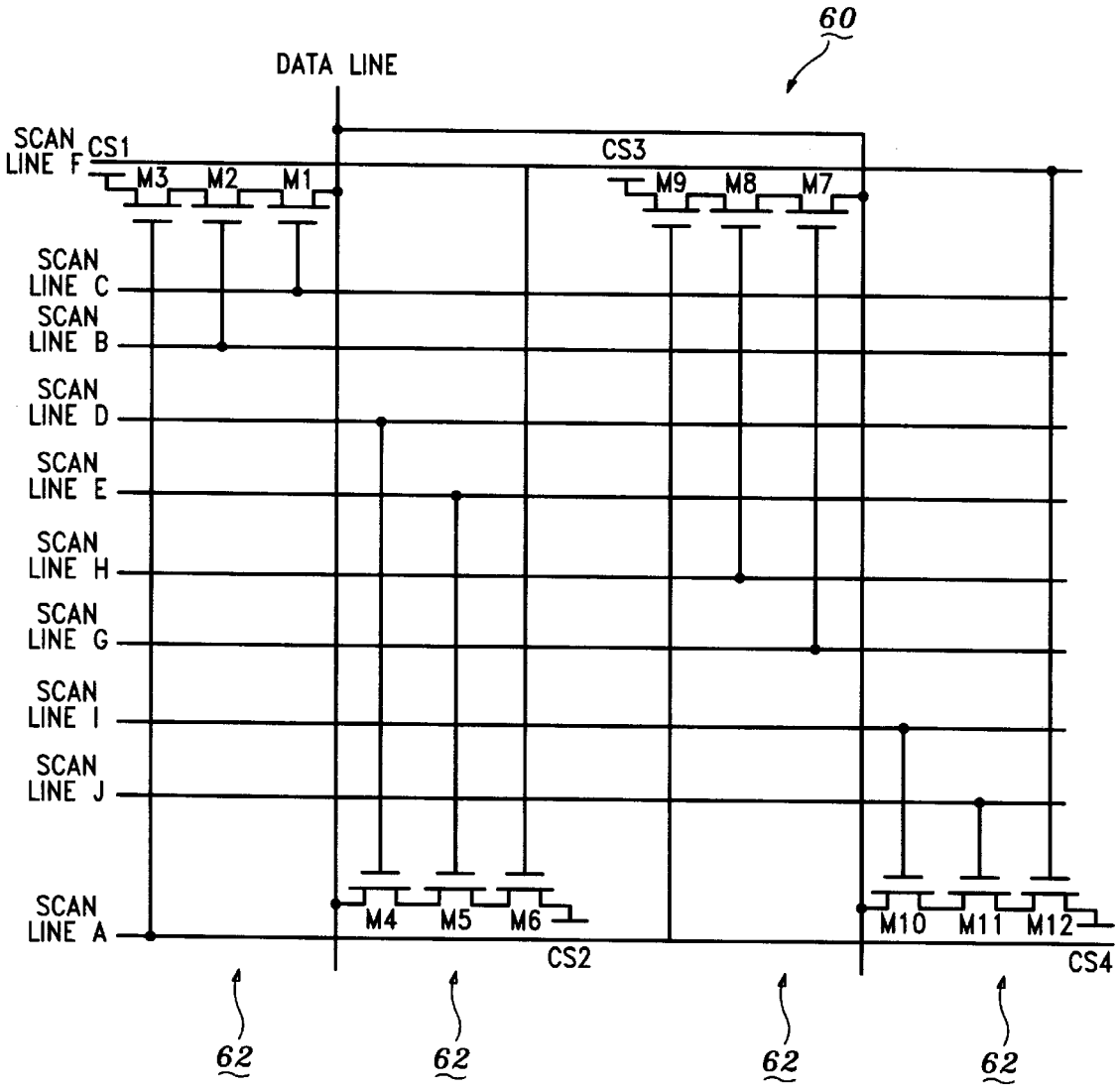
FIG. 12 is a schematic diagram of a pixel circuit having a four pixel layout with a common data line and three TFTs in series per pixel in accordance with the present invention.
Figure 13:
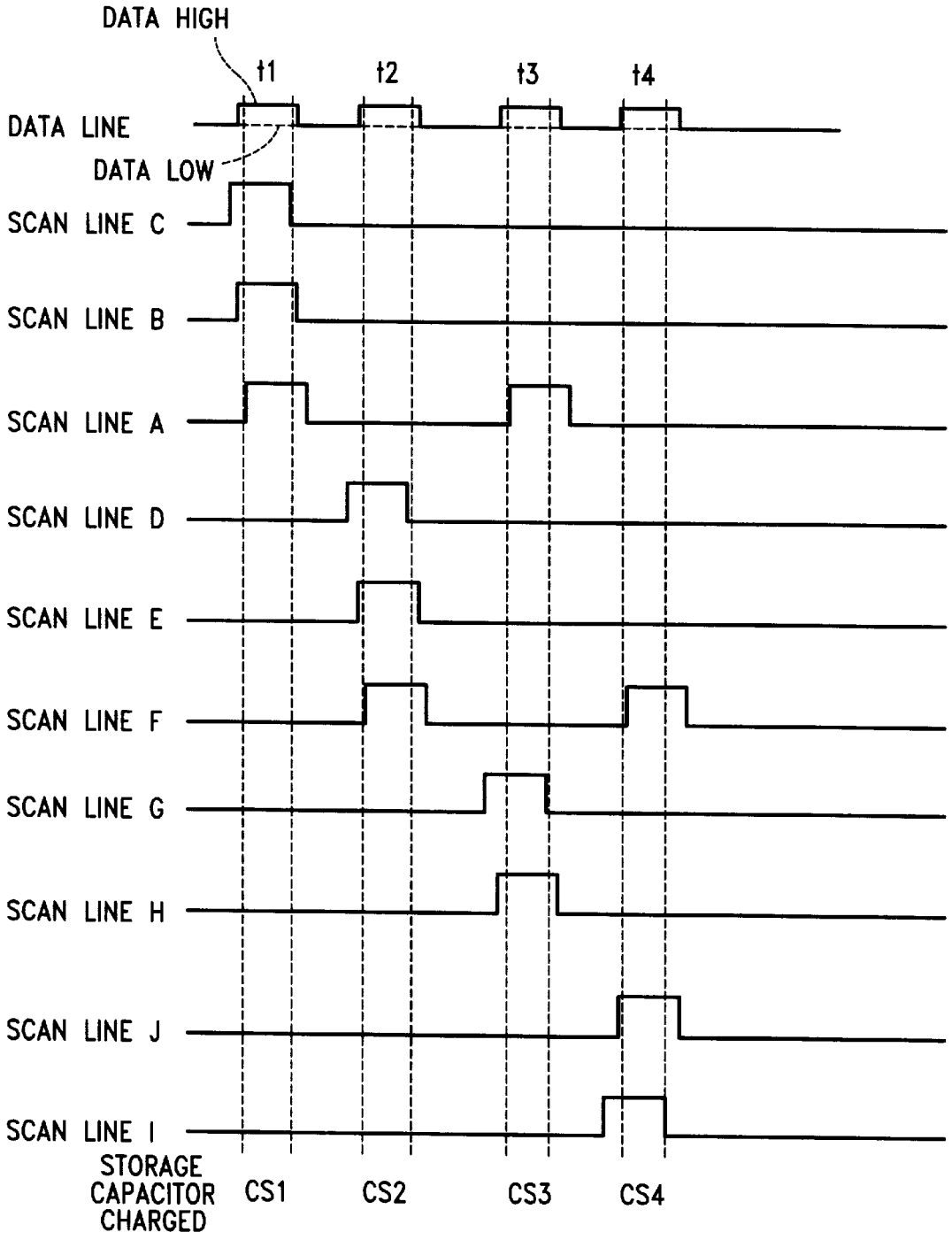
FIG. 13 is a timing diagram for the circuit of FIG. 12 in accordance with the present invention.

Referring to FIG. 12, a schematic diagram of a circuit 60 is shown. Circuit 60 includes a common DATA LINE and three TFTs per pixel 62. Circuit 60 is a 4:1 data demultiplexing representation of circuit 20 of FIG. 3. Scan lines G, H, I and J are added to accomplish this. The TFTs are serially connected in groups of three (i.e., M1, M2, M3; M4, M5, M6; M7, M8, M9; and M10, M11, M12), each group functions similarly. CS1, CS2, CS3 and CS4 are storage capacitor nodes. FIG. 13 illustrates an example of a timing diagram for circuit 60.

Figure 14:
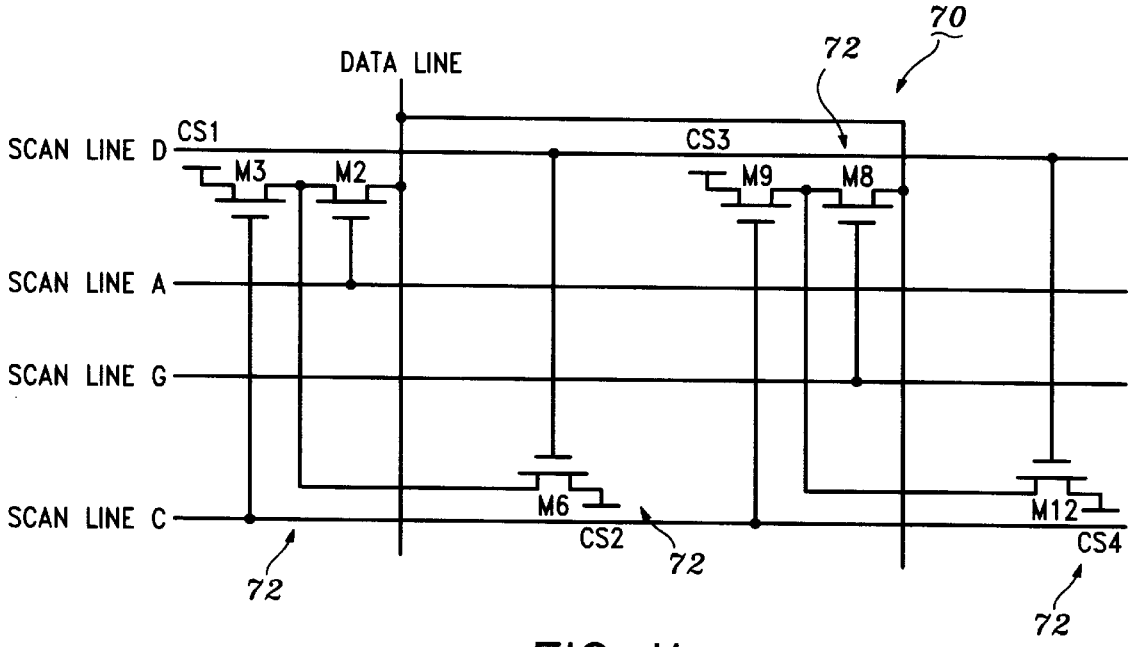
FIG. 14 is a schematic diagram of a pixel circuit effectively having one and one half TFTs per pixel due to a shared TFT between adjacent pixels for 4:1 multiplexing in accordance with the present invention.
Figure 15:
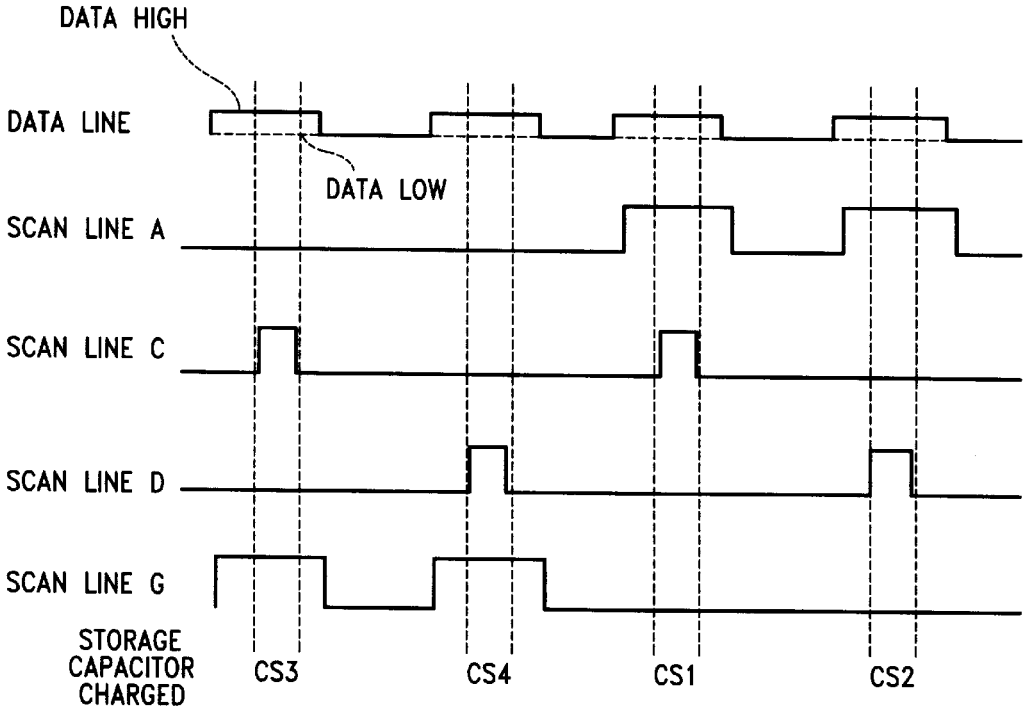
FIG. 15 is a timing diagram for the circuit of FIG. 14 in accordance with the present invention.

Referring to FIG. 14, a schematic diagram of a circuit 70 is shown. Circuit 70 includes a common DATA LINE and two TFTs per pixel 72 in which one TFT (M2, M8) is shared between two pixels (an efficient one and one half (1½)TFT per pixel layout). Circuit 70 is a 4:1 data demultiplexing representation of circuit 40 of FIG. 7. Scan line G is added to accomplish this. A common DATA LINE is used for four pixels 72. FIG. 15 illustrates an example of a timing diagram for circuit 70.

It is understood that the circuits described above may be implemented on a semiconductor device. Advantageously, circuit 30 yields a high aspect ratio and provides a reduction in number of both data and gate drivers when compared to the prior art X–Y addressed displays. Table 1 compares the number of lines needed for a display.

Table 1.

X=number of rows

Y=number of columns (i.e., RGB columns)

$R_{xy}$=Y/X information content aspect ratio of a panel (typically 4:3).

TABLE 1

| Display Address Type | # of horizontal lines in array | # of vertical lines in array | total # of array connections | total # of array connections for aspect ration 4:3 | total # of array connections for aspect ration 16:9 |
|---|---|---|---|---|---|
| Prior art | X | 3Y or $3R_{xy}$*X | $(1 + 3R_{xy})$*X | 5X | ~6.333X |
| Prior Art with delta-RGB pixel layout | 1.5X | 2Y or $2R_{xy}$*X | $(1.5 + 2R_{xy})$*X | ~4.167X | ~5.056X |
| Circuit 40 | 2X + 1 | 1.5Y or $1.5R_{xy}$*X | $(2 + 1.5R_{xy})$*X | 4X + 1 | ~4.667 + 1 |

X = number of rows
Y = number of columns (i.e., RGB columns)
$R_{xy}$ = Y/X information content aspect ratio of a panel (typically 4:3).

Table 1 illustratively demonstrates a reduction the present invention yields for vertical lines. The result is a 2:1 data demultiplexing effect. The total number of horizontal lines in the display may be increased, however, if this is the case the total number of connections (lines for tabbing external drivers) for the 4:3 or the 16:9 aspect ratio displays are minimized in accordance with the present invention. Further improvements in demultiplexing may be realized if the fanout structure as shown in FIG. 9 is employed. Gate drivers are further reduced in numbers and the data demultiplexing becomes m:1 where m is an integer greater than one and equal to the number of stages implemented as described in FIG. 9.

Figure 16:
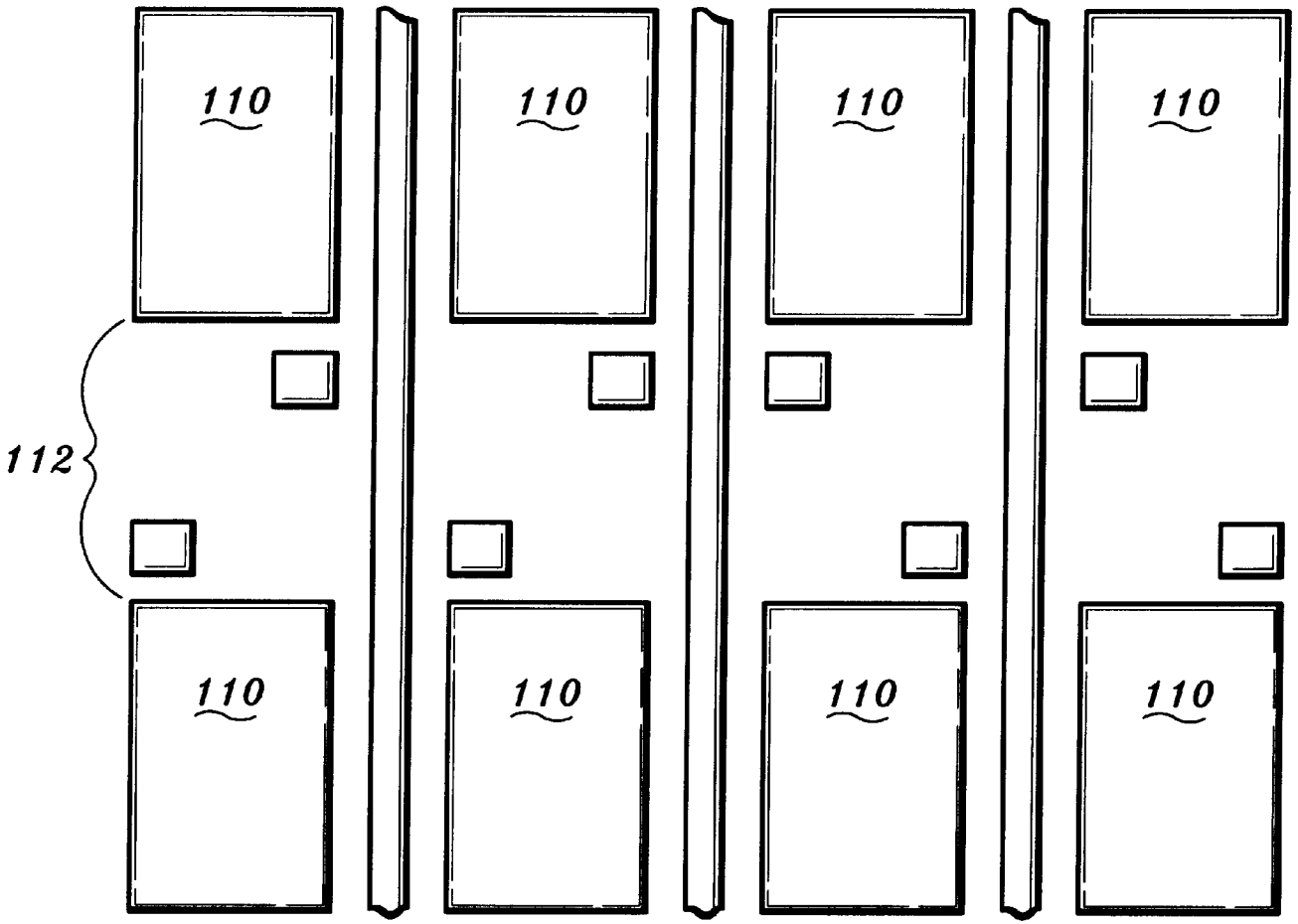
FIG. 16 is a top plan view of a semiconductor device layout implementing the present invention and showing logic circuitry.

Referring to FIG. 16, an illustrative layout is shown for an implementation of the present invention. Pixels 110 are shown. Between rows of pixels a circuit region 112 is provided in accordance with the present invention. Circuit region 112 may include TFTs, scan lines, data lines, storage node lines, connections, etc. as described. Alternately, circuit region 112 may include logic circuitry including AND gates or other logic gates such as OR, NOR, NAND and/or XOR gates. Thus, the selection of control lines such as scan lines will be performed using logic gates having control or enable signals which are logically combined to transmit an appropriate control signal to TFTs. Logic gates may also be included externally to the pixel areas.

Pixels 110 may include a transmissive mode and a reflective mode. Transmissive mode includes modulating light from a surface of pixel 110 by modulating a capacitive voltage to the pixel to transmit light directly therefrom. Reflective mode includes preparing the pixel to modulate light therefrom by reflecting light incident on its surface.

It is to be understood that the present invention may be implemented with various semiconductor technologies, for example crystalline silicon, amorphous silicon, polysilicon, organic materials, Si—Ge and/or CdS. The embodiments of the present invention may be implemented on any active matrix display without impacting conventional fabrication processes. In preferred embodiments, the displays are used in lap top computers or other electronic devices having LCDs. Further, the present invention implements multiplexing/demultiplexing capability while reducing components and cost. Layouts may have reduced area where the transistors are disposed on a substrate and the pixels are formed over the transistors in accordance with the invention.

Having described preferred embodiments of multiplexing pixel circuits (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. An active matrix display comprising:

a plurality of pixels arranged in an array, wherein the array comprises rows and columns and control lines select the pixels in different rows simultaneously;

at least two transistors associated with each pixel, the transistors serially connected to each other and disposed within the array for switching the pixels on and off according to data signals and gate signals; and a data line coupled to a first end of the serially connected transistors and shared between the transistors of different pixels;

a second end of the serially connected transistors coupling to a storage device and the pixel;

the serially connected transistors providing multiplexing for at least one data signal multiplexing and gate signal multiplexing of each pixel by selectively enabling the at least two transistors for each pixel in accordance with the gate signals.

2. The display as recited in claim 1, wherein one of the at least two transistors is shared between adjacent pixels.

3. The display as recited in claim 1, wherein the pixels modulate light in a transmissive mode.

4. The display as recited in claim 1, wherein the pixels modulate light in a reflective mode.

5. The display as recited in claim 1, wherein the control lines include data lines and the simultaneously selected pixels share a data line.

6. The display as recited in claim 1, wherein the control lines include data lines and the simultaneously selected pixels each use a different data line.

7. The display as recited in claim 1, further comprising scan lines for connecting to gates of the transistors for activating the transistors.

8. The display as recited in claim 7, wherein the scan lines include capacitance storage lines.

9. The display as recited in claim 1, wherein control lines are coupled to the transistors by a low impedance path.

10. The display as recited in claim 9, wherein the low impedance path includes one of a metal, a doped amorphous silicon and a polycrystalline silicon.

11. The display as recited in claim 9, wherein the low impedance path includes a capacitor.

12. The display as recited in claim 1, wherein the display includes a liquid crystal display.

13. The display as recited in claim 1, wherein the transistors include thin film transistors.

14. The display as recited in claim 1, further comprising logic circuitry for controlling the multiplexing in accordance with control signals.

15. The display as recited in claim 1, wherein the transistors are disposed on a substrate and the pixels are formed over the transistors.

16. The display as recited in claim 15, wherein the transistors are disposed on a substrate and the pixels are formed over the transistors.

17. An active matrix display comprising:

a plurality of pixels arranged in an array including rows and columns;

at least two trnasistors associated with each pixel, the transistors being serially connected and positioned within the array for switching the pixels on and off;

a plurality of data lines running substantially parallel to the columns;

a plurality of scan lines running substantially parallel to the rows; and the data lines and scan lines being coupled to the transistors of the pixels and shared between the transistors of different pixels such that the data lines provide data multiplexing for each pixel and the scan lines provide gate multiplexing for each pixel by selectively enabling the at least two transistors for each pixel in accordance with data signals on the data lines and gate signals on the gate lines, wherein the data signal multiplexing comprises L:1 multiplexing, and the gate signal multiplexing comprises M:1 multiplexing where L and M each comprise an integer greater than one, respectively.

18. The display as recited in claim 17, wherein one of the at least two transistors is shared between adjacent pixels.

19. The display as recited in claim 17, wherein the pixels modulate light in a transmissive mode.

20. The display as recited in claim 17, wherein the pixels modulate light in a reflective mode.

21. The display as recited in claim 17, wherein control lines select pixels in different rows simultaneously.

22. The display as recited in claim 17, wherein the pixels share a data line.

23. The display as recited in claim 17, wherein the pixels each have a different data line.

24. The display as recited in claim 17, wherein the scan lines include capacitance storage lines.

25. The display as recited in claim 17, wherein the control lines are coupled to the transistors by a low impedance path.

26. The display as recited in claim 25, wherein the low impedance path includes a capacitor.

27. The display as recited in claim 17, wherein the display includes a liquid crystal display.

28. The display as recited in claim 17, wherein the transistors include thin film transistors.

29. The display as recited in claim 17, further comprising logic circuitry for controlling the multiplexing in accordance with control signals.

30. The display as recited in claim 17, wherein the array comprises rows and columns and control lines select the pixels in different rows simultaneously.

31. The display as recited in claim 30, wherein the control lines include data lines and the simultaneously selected pixels share a data line.

32. The display as recited in claim 30, wherein the control lines include data lines and the simultaneously selected pixels each use a different data line.

33. An active matrix display comprising:

a plurality of pixels arranged in an array;

at least two transistors associated with each pixel, the transistors serially connected to each other and disposed within the array for switching the pixels on and off according to data signals and gate signals; and a data line coupled to a first end of the serially connected transistors and shared between the transistors of different pixels;

a second end of the serially connected transistors coupling to a storage device and the pixel;

the serially connected transistors providing multiplexing for at least one of data signal multiplexing and gate signal multiplexing of each pixel by selectively enabling the at least two transistors for each pixel in accordance with the gate signals, wherein the data signal multiplexing comprises L:1 multiplexing, and the gate signal multiplexing comprises M:1 multiplexing where L and M each comprise an integer greater than one, respectively.

34. The display as recited in claim 33, wherein the array comprises rows and columns and control lines select the pixels in different rows simultaneously.

* * * * *